United States Patent [19]

Schoenwald

[11] Patent Number: 4,943,208

[45] Date of Patent: Jul. 24, 1990

[54] MULTI-STAGE LATERAL CHANNEL COMPRESSOR

[75] Inventor: Siegfried Schoenwald, Bad Neustadt, Fed. Rep. of Germany

[73] Assignee: Siemens Aktiengesellschaft, Berlin & Munich, Fed. Rep. of Germany

[21] Appl. No.: 350,718

[22] Filed: May 11, 1989

[30] Foreign Application Priority Data

May 30, 1988 [DE] Fed. Rep. of Germany ..... 3818374

[51] Int. Cl.[5] ..... F04B 5/00

[52] U.S. Cl. ..... 415/175; 415/55.1; 417/243; 417/244

[58] Field of Search ..... 415/55.1, 55.5, 55.6, 415/177, 110, 120, 180, 111, 112, 175; 417/243, 244

[56] References Cited

U.S. PATENT DOCUMENTS

| | | | |
|---|---|---|---|
| 3,255,700 | 6/1966 | Keller et al. | 415/55.1 |
| 3,395,853 | 8/1968 | Zoehfeld | 415/55.1 |
| 3,518,021 | 6/1970 | Lake et al. | 415/55.1 |
| 4,204,800 | 5/1980 | Bentele et al. | 415/55.6 |
| 4,204,802 | 5/1980 | Schönwald et al. | 415/55.1 |
| 4,477,223 | 10/1984 | Giroux | 415/110 |

FOREIGN PATENT DOCUMENTS

| | | | |
|---|---|---|---|
| 731022 | 12/1942 | Fed. Rep. of Germany . | |
| 731085 | 12/1942 | Fed. Rep. of Germany . | |
| 733433 | 2/1943 | Fed. Rep. of Germany . | |
| 715545 | 6/1946 | Fed. Rep. of Germany | 415/56 |
| 1817430 | 12/1969 | Fed. Rep. of Germany . | |
| 2294114 | 7/1976 | France . | |
| 353 | 1/1916 | United Kingdom . | |

OTHER PUBLICATIONS

W. E. Trumpler et al., Transactions of the ASME, "Heat-Transfer Rates in Centrifugal Compressors and the Effect of Internal Liquid Cooling on Performance", pp. 797-804, (May, 1950).

*Primary Examiner*—Edward K. Look
*Assistant Examiner*—Hoang Nguyen
*Attorney, Agent, or Firm*—Kenyon & Kenyon

[57] ABSTRACT

The invention relates to a multi-stage lateral channel compressor, wherein the housings of the individual compressor stages consisting of individual housing shells are arranged axially, one behind the other, and are mechanically interconnected, wherein, in addition, a common driving shaft is provided for the impellers of the individual compressor stages, and a coolant is provided in the interspace which exists between the housings of the individual compressor stages. An intensive cooling is thereby achieved, in that the interspace is sealed both from the outside and also against the driving shaft, an inlet and an outlet orifice are each assigned to the interspace and a liquid coolant, which flows through the interspace, is supplied and evacuated by way of these orifices.

7 Claims, 2 Drawing Sheets

MULTI-STAGE LATERAL CHANNEL COMPRESSOR

FIELD OF THE INVENTION

The invention relates to a multi-stage lateral channel compressor in which the housing of the individual compressor stages are arranged axially, one behind the other, and are mechanically interconnected such that an interspace exists between the housings of the individual compressor stages and in which a common driving shaft is provided for the impellers of the individual compressor stages and a cooling system is provided in the interspace.

BACKGROUND OF THE INVENTION

Such a lateral channel compressor is known from the German Published Patent Application 18 17 430. In this known lateral channel compressor, a separate cooling system is arranged between the housings of both compressor stages to dissipate the heat produced during compression. This cooling system consists of a ventilator, which forces cooling air through air guides connected to both housings.

Assembling this type of cooling system entails considerable expenditure. Even if the air guides are manufactured in one piece with the appropriate housing parts, the ventilator must nevertheless be mounted between both housings.

SUMMARY OF THE INVENTION

The present invention provides a multi-stage lateral channel compressor of the aforementioned type which will cool more efficiently and, at the same time, entail less expenditure of assembly and material.

Specifically, the present invention provides a multi-stage lateral chamber compressor in which the interspace is sealed both from the outside and also against the driving shaft. An inlet orifice communicates with the sealed interspace to supply a liquid coolant to the sealed interspace; the coolant flows through the interspace and an outlet orifice communicates with the sealed interspace to evacuate liquid coolant from the sealed interspace.

By virtue of this construction, a very intensive cooling results, by simply supplying a liquid coolant in the already existing interspace between the housings of the individual compressor stages. All that is required to enable this cooling with the liquid coolant, is sealing the interspace and providing an appropriate inlet and outlet orifice for the liquid coolant. A further advantage of using the already existing interspace is that the overall length of the lateral channel compressor does not need to be increased, even though a good cooling function is still obtained. Thus, the length of the shaft of the lateral channel compressor can be minimized. This is necessary to avoid critical rotational speeds.

According to a refinement of the invention, the inlet and outlet orifices are provided on the respective housing, in the area of an interrupter, which separates the housing's intake port from its exhaust port. Since there is no lateral channel in the area of the interrupter, sufficient space is available for the intake and exhaust port, and it is not necessary to increase the overall length of the lateral channel compressor.

The ventilation, which is required when filling up the interspace with liquid coolant, can be achieved simply by connecting the outlet orifice with the highest point of the interspace. The connection between the outlet orifice and the highest point of the interspace relative to the service position of the compressor (i.e. the typical position or orientation of the compressor when it is in operation or service), is either direct or by way of a vent line.

To achieve the required circulation of the liquid coolant, a blocking wall is provided in the interspace. The blocking wall separates the incoming flow of the cooling medium from the return flow.

In accordance with one embodiment of the present invention, by designing the opposite-facing housing shells of adjacent compressor stages in one piece (integrally) and by defining the interspace by the one-piece housing part, one obtains a cavity, which is completely closed, except for the openings which are needed in the manufacturing process. Thus, only these openings need to be sealed.

BRIEF DESCRIPTION OF THE DRAWINGS

The present invention is described in greater detail in the following, based on an exemplified embodiment depicted in the drawings in which.

DETAILED DESCRIPTION

Figure 1:
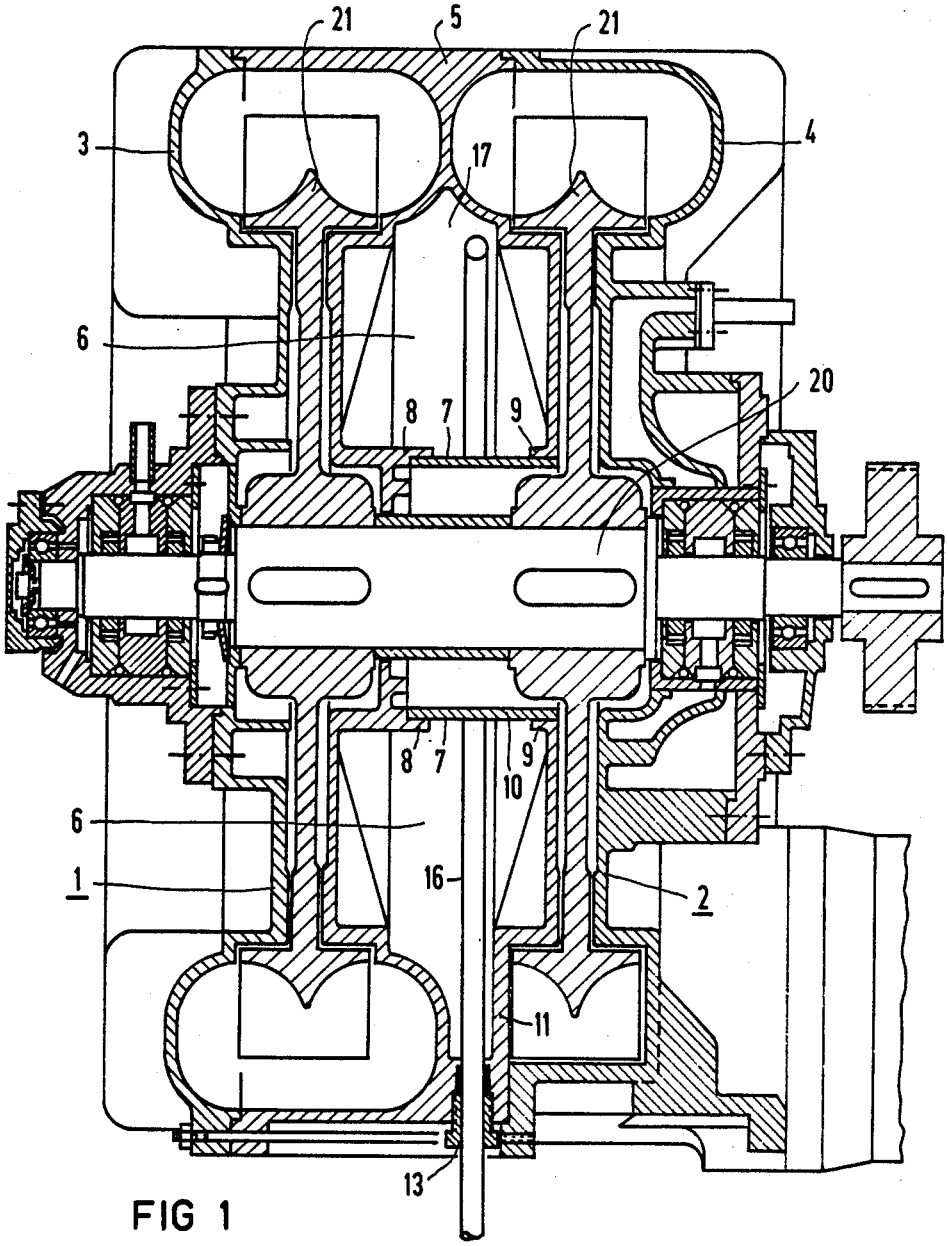
FIG. 1 is a multi-stage lateral channel compressor in a longitudinal cross section.

FIG. 1 illustrates two lateral channel compressors 1 and 2, which form the individual compressor stages of a multistage lateral channel compressor. The housings of these lateral channel compressors 1 and 2 consist of outer housing shells 3 and 4, as well as a common inner housing shell 5. This inner housing shell 5 is designed so that, together with both mounted outer housing shells 3 and 4, it forms two complete compressor housings. The impellers 21 of the individual compressor stages, which are arranged on a common driving shaft 20, are located in these compressor housings. In 15 the case of an even higher-stage design of the lateral channel compressor, the inner housing shell 5 has an additional inner housing shell attached to it, which in turn, can also have this type of an inner housing shell or the appropriate outer housing shell 3 or 4 mounted on to it.

When individual housings are joined, in the case of a multi-stage lateral channel compressor, an interspace 6 results between these housings. This is conditional on the constructional form of the lateral channel compressor housing. Reference numeral 17 indicates the highest or uppermost point of the interspace when the compressor is in the erect position, i.e., normal operating or service position.

The single-piece design of the inner housing shell 5 results in an interspace 6 which is completely closed, except for the annular or ring opening 7 in the hub area of the housing shell 5. This annular opening is required in the manufacturing of this housing shell 5. The annular or ring opening 7 is closed or sealed by means of a tubular piece 10, which abuts tightly against the hub attachments 8 and 9 of the inner housing shell 5.

In accordance with one aspect of the present invention, this interspace 6 can be used to cool the individual compressor stages with a liquid coolant.

An intake port 12 and an exhaust port 13 are provided on the inner housing shell 5, in the area of the interrupter 11 of the one lateral channel compressor 2. A feeder line 14 is connected to the intake port 12 and a discharge line 15 is connected to the exhaust port 13. In addition, a vent line 16, which leads to the highest point 17 of the interspace 6, in the erect or service position of the lateral channel compressor, is connected to the exhaust port 13. This construction guarantees the ventilation of the interspace 6, which is required to fill it with liquid coolant. The vent line 16 can be dispensed with, if the exhaust port 13, itself, lies at the highest point 17 of the interspace 6, in the service position of the lateral channel compressor.

Figure 2:
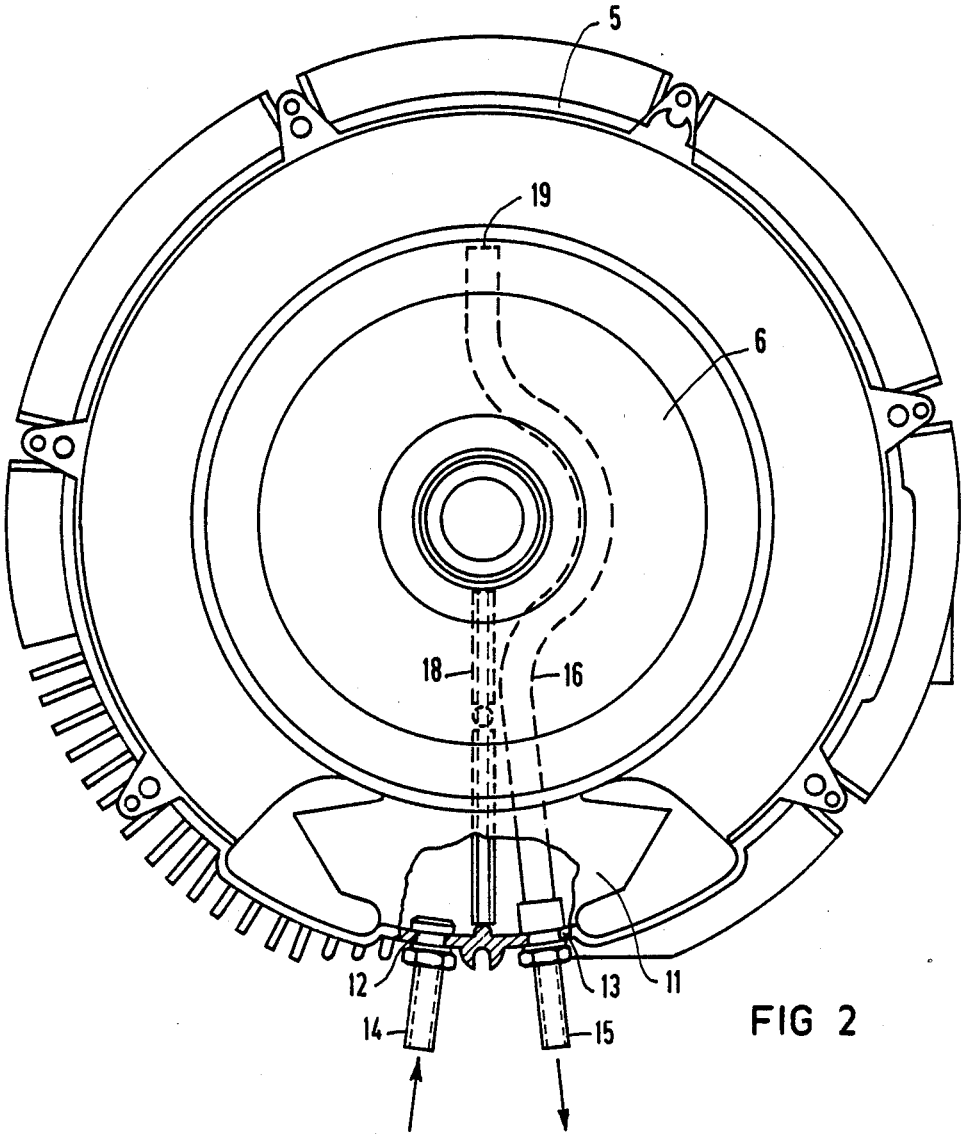
FIG. 2 is a plan view of a housing part arranged between two compressor stages.

To circulate the liquid coolant in the interspace 6, as required, and to prevent the liquid coolant from flowing directly from the intake port 12 to the exhaust port 13, a blocking wall 18 is inserted in the interspace 6. The blocking wall separates the incoming flow of the coolant from the return flow of the coolant. This blocking wall 18 can be dispensed with, if, in the ereot or servioe position of the lateral channel compressor, according to the representation of FIG. 2, the intake port 12 lies on the bottom, and the mouth 19 of the vent line 16 lies on the top in the interspace 6. In this case, the desired circulation results already.

What is claimed is:

1. A multi-stage lateral channel compressor comprising:

a plurality of compressor stages, each compressor stage including a housing comprising at least two housing shells and an impeller; the compressor stages being arranged axially one behind another and mechanically interconnected so as to form an interspace between the housings of the individual compressor stages;

a common driving shaft for driving the impellers of the individual compressor stages;

means for sealing the interspace both from the outside and also against the driving shaft;

a supply of coolant; and an inlet orifice and an outlet orifice communicating the supply of coolant with the interspace, whereby coolant is supplied to the interspace via the inlet orifice, flows through the interspace and is evacuated via the outlet orifice.

2. The lateral channel compressor of claim 1, the compressor housing further comprising an intake port an exhaust port and an interrupter separating the intake port from the exhaust port;

wherein the inlet orifice and the outlet orifice are provided on the housing proximate the interrupter.

3. The lateral channel compressor of claim 1 wherein the compressor has a service position corresponding to its orientation in use and the interspace has an uppermost point when the compressor is in the service position and wherein the outlet orifice is connected to the uppermost point of the interspace.

4. The lateral channel compressor of claim 3 wherein the outlet orifice is connected to the uppermost point of the interspace via a vent line.

5. The lateral channel compressor of claim 1 further comprising a blocking wall provided in the interspace, the blocking wall separating the incoming flow of the coolant from the return flow of the coolant so as to prevent coolant from flowing directing from the intake port to the exhaust port.

6. The lateral channel compressor of claim 1 wherein the opposite-facing housing shells of adjacent compressor stages are integral so as to define a continuous interspace housing.

7. A multi-stage later channel compressor comprising:

an inlet housing shell, at least one inner housing shell, and an outlet housing shell, the inlet housing shell, at least one inner housing shell and outlet housing shell being serially axially arranged to define a plurality of compressor stage housings, each compressor stage including an impeller;

a common driving shaft for driving each of the impellers of the compressor;

an interspace defined within at least one inner housing shell;

a tubular piece sealingly connected to the inner housing shell to seal the interspace from the common driving shaft;

a supply of coolant;

an inlet orifice and an outlet orifice communicating the supply of coolant with the interspace such that coolant is supplied to the interspace via the inlet orifice, flows through the interspace and is evacuated via the outlet orifice.

* * * * *